US009493919B2

(12) United States Patent
Handy

(10) Patent No.: US 9,493,919 B2
(45) Date of Patent: Nov. 15, 2016

(54) TRAFFIC BARRIER ASSEMBLY

(71) Applicant: Jacquelyn Handy, Huron, OH (US)

(72) Inventor: Jacquelyn Handy, Huron, OH (US)

( * ) Notice: Subject to any disclaimer, the term of this patent is extended or adjusted under 35 U.S.C. 154(b) by 231 days.

(21) Appl. No.: 14/285,934

(22) Filed: May 23, 2014

(65) Prior Publication Data

US 2015/0337507 A1 Nov. 26, 2015

(51) Int. Cl.
*E01F 9/012* (2006.01)

(52) U.S. Cl.
CPC ..... *E01F 9/688* (2016.02); *E01F 9/617* (2016.02); *E01F 9/654* (2016.02)

(58) Field of Classification Search
CPC ..... E01F 9/012; E01F 9/0122; E01F 13/02; E01F 9/617; E01F 9/654; E01F 9/688
USPC ..... 116/63 P, 63 C; 40/610, 612; 404/6, 9, 404/10
See application file for complete search history.

(56) References Cited

U.S. PATENT DOCUMENTS 3,496,904 A * 2/1970 Rimkus ..... E01F 9/0122 116/63 C
4,006,702 A * 2/1977 St. Cyr ..... E01F 9/0165 116/63 P
4,317,617 A * 3/1982 Charlton ..... E01F 9/0122 116/63 P
D276,142 S 10/1984 Dobrin
4,489,306 A * 12/1984 Scolari ..... B60Q 7/00 116/63 P
4,674,431 A * 6/1987 Cory ..... E01F 9/0122 116/202
4,798,747 A * 1/1989 Laramee ..... E01F 9/0122 116/63 C
4,973,189 A * 11/1990 Bechtold ..... E01F 13/02 206/1.5
4,973,190 A 11/1990 Erwin et al.
5,375,553 A * 12/1994 Chen ..... E01F 9/0122 116/63 C
5,529,429 A * 6/1996 Pelegrin ..... B60Q 7/00 116/63 C
5,755,528 A * 5/1998 Kulp et al. ..... E01F 9/0124 116/63 P
6,017,602 A 1/2000 Baker et al.
6,019,542 A * 2/2000 Bent ..... E01F 13/02 116/63 P
6,071,037 A 6/2000 Holt
6,685,857 B2 2/2004 Dowling et al.
6,808,081 B1 * 10/2004 Citro ..... B65D 25/2805 116/63 P
6,971,329 B1 * 12/2005 Stewart ..... E01F 13/028 116/63 C
2002/0062780 A1 * 5/2002 Chen ..... B60Q 7/005 116/63 P
2006/0204328 A1 9/2006 Frey
2010/0316443 A1 * 12/2010 Setzer et al. ..... G09F 13/20 404/12

FOREIGN PATENT DOCUMENTS

CN 201010867 Y * 1/2008 ..... E01F 9/012
CN 202466443 U * 10/2012 ..... E01F 9/012
CN 203174522 U * 9/2013 ..... E01F 9/012
EP 0656445 A1 * 6/1995 ..... B60Q 7/00
FR 2995327 A1 * 3/2014 ..... E01F 9/0116

* cited by examiner

*Primary Examiner* — R. A. Smith

(57) ABSTRACT

A traffic barrier assembly alerts motorists to a hazardous road condition and helps guide the flow of traffic around the hazardous condition. The assembly includes a base member having a top end, a bottom end and a perimeter wall attached to and extending between the top end and the bottom end. A top member has a top edge, a bottom edge and a peripheral wall attached to and extending between the top edge and the bottom edge. The top edge defines an opening extending into an interior of the top member. The top member is telescopic relative to base member.

16 Claims, 7 Drawing Sheets

TRAFFIC BARRIER ASSEMBLY

BACKGROUND OF THE DISCLOSURE

Field of the Disclosure

The disclosure relates to road barrier assemblies and more particularly pertains to a new road barrier assembly for alerting motorists to a hazardous road condition and helping to guide the flow of traffic around the hazardous condition.

SUMMARY OF THE DISCLOSURE

An embodiment of the disclosure meets the needs presented above by generally comprising a base member having a top end, a bottom end and a perimeter wall attached to and extending between the top end and the bottom end. A top member has a top edge, a bottom edge and a peripheral wall attached to and extending between the top edge and the bottom edge. The top edge defines an opening extending into an interior of the top member. The top member is telescopic relative to base member.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
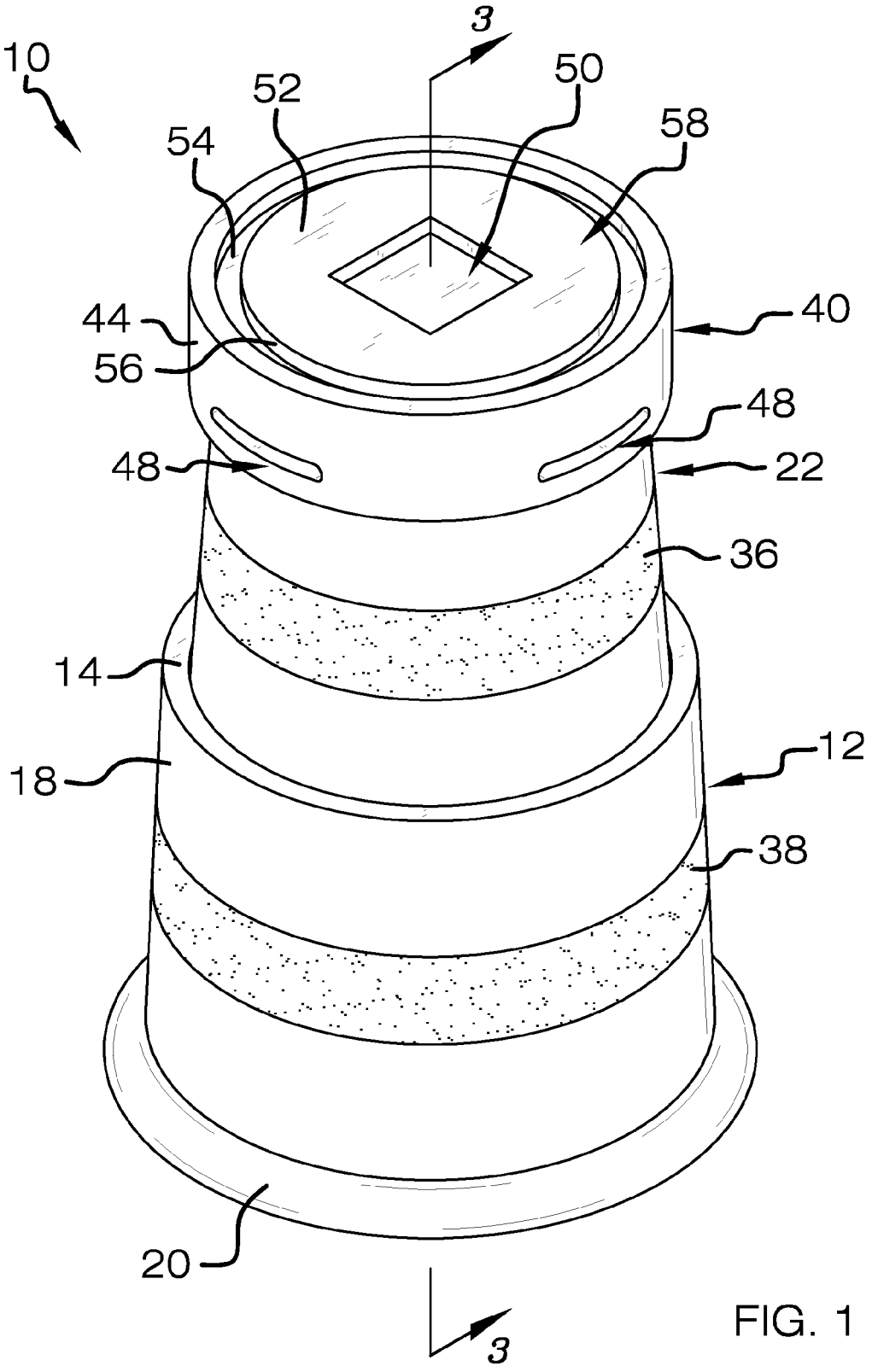
FIG. 1 is a top front side perspective view of a traffic barrier assembly according to an embodiment of the disclosure.
Figure 2:
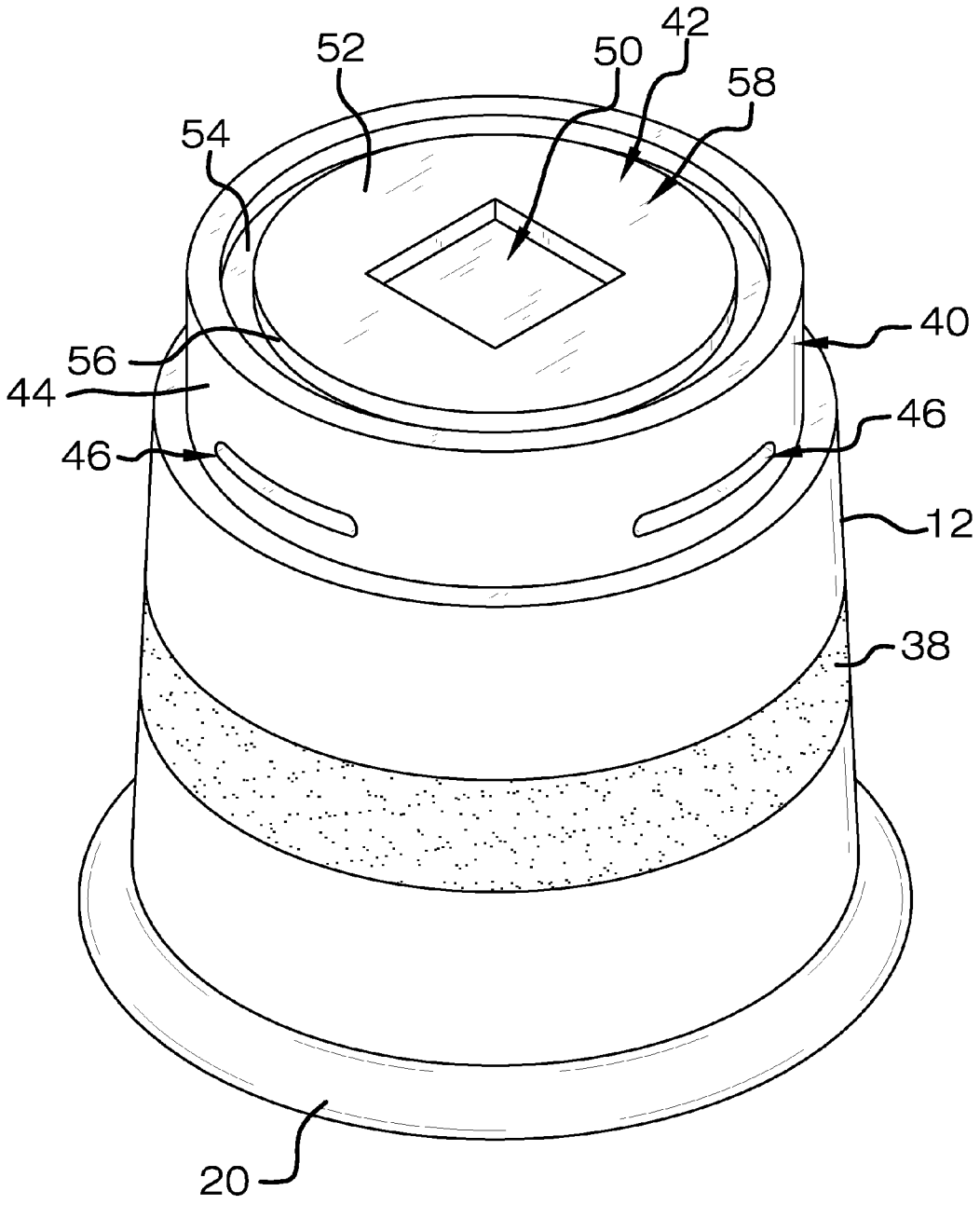
FIG. 2 is a top front side perspective view of an embodiment of the disclosure showing the collapsible nature of the assembly.
Figure 3:
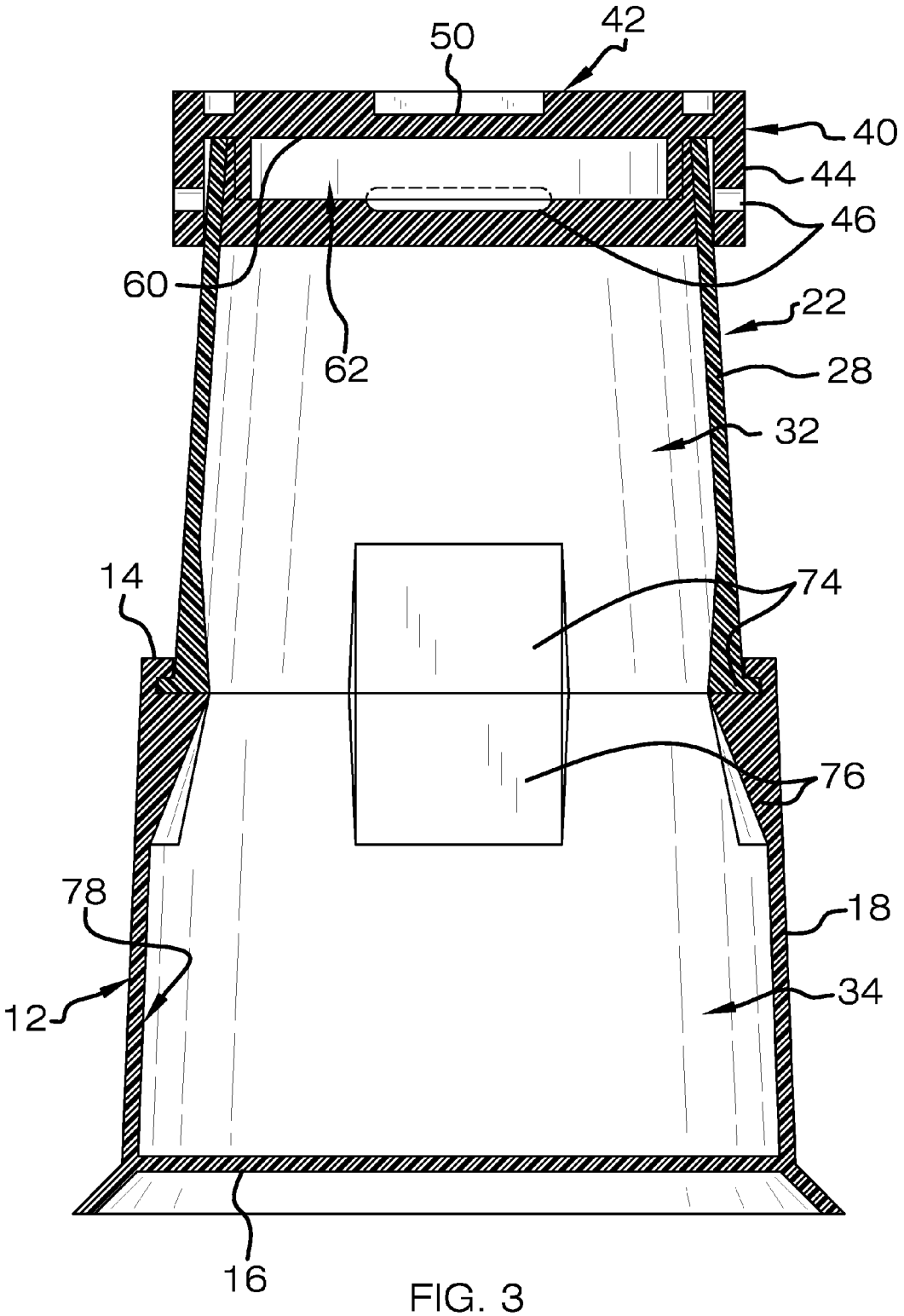
FIG. 3 is a cross-sectional view of an embodiment of the disclosure taken along line 3-3 of FIG. 1.
Figure 4:
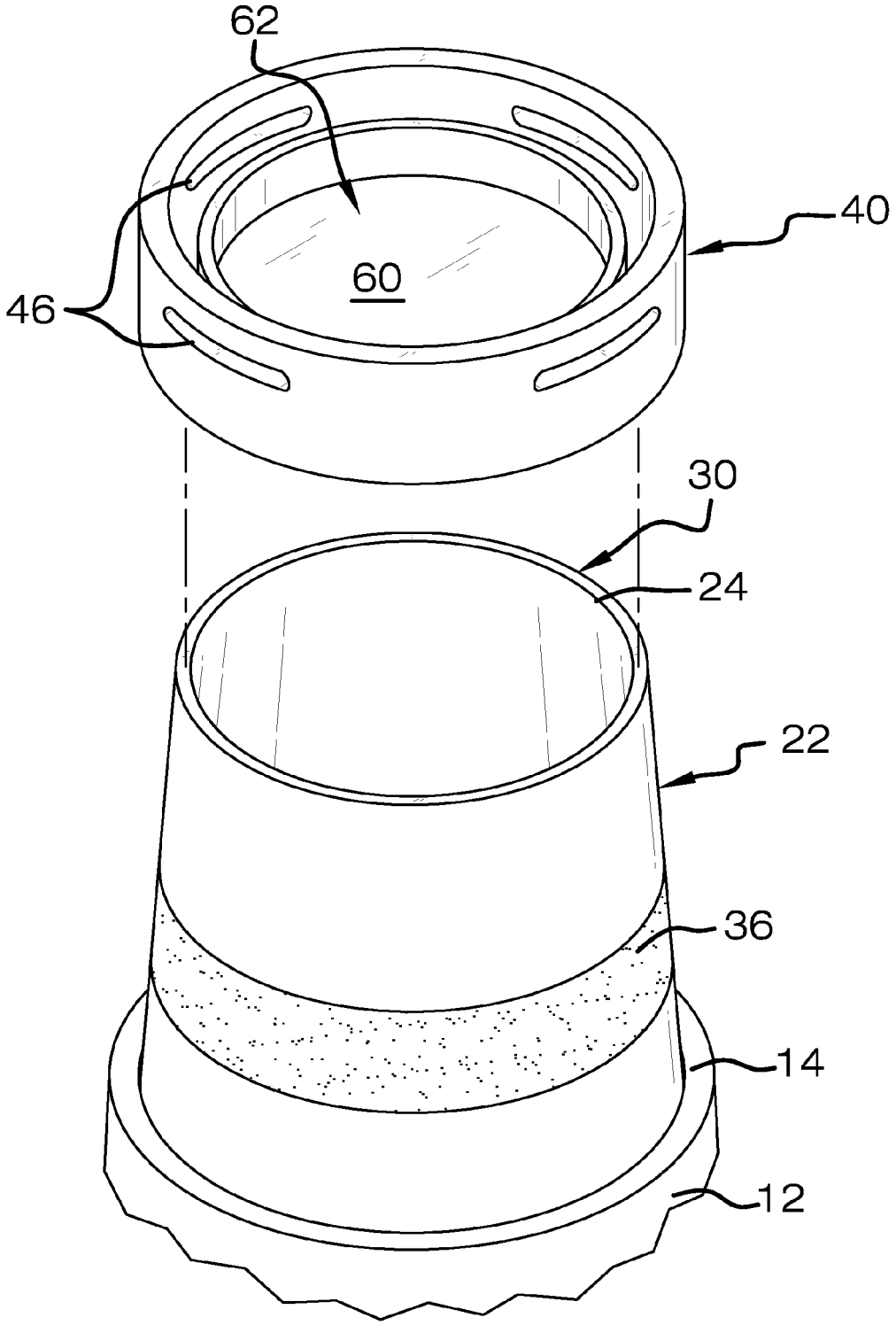
FIG. 4 is an exploded view of an embodiment of the disclosure showing the lid being removable from the top member.
Figure 5:
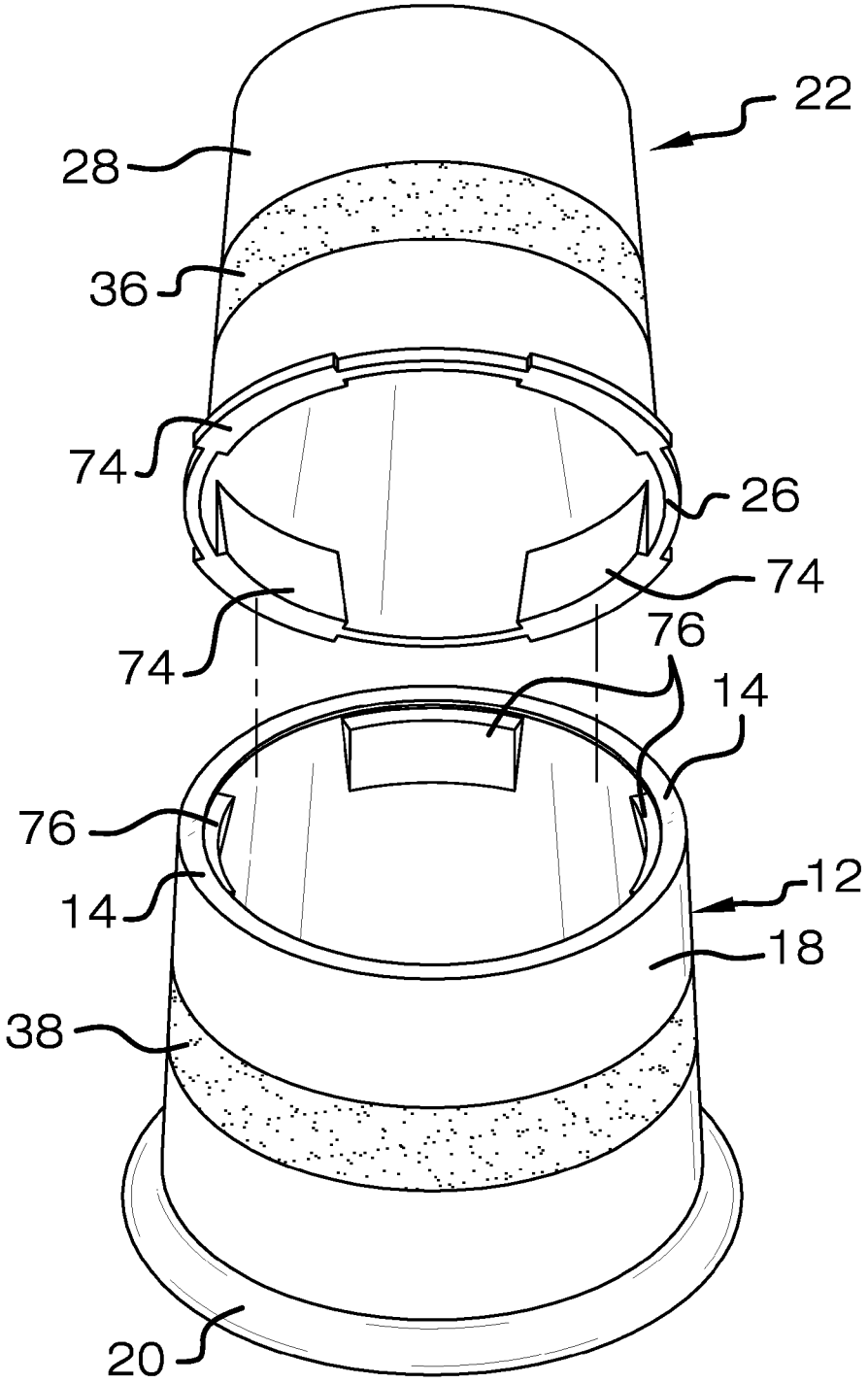
FIG. 5 is an exploded view of an embodiment of the disclosure showing the tabs and the lips.

With reference now to the drawings, and in particular to FIGS. 1 through 7 thereof, a new road barrier assembly embodying the principles and concepts of an embodiment of the disclosure and generally designated by the reference numeral 10 will be described.

As best illustrated in FIGS. 1 through 7, the traffic barrier assembly 10 generally comprises a base member 12 having a top end 14, a bottom end 16 and a perimeter wall 18 attached to and extending between the top end 14 and the bottom end 16. The bottom end 16 may be closed to hold ballast, such as sand, therein in order to securely position the base member 12 on a ground surface. A rim 20 may be attached to the bottom end 16 that extends therearound. The rim 20 may taper outwardly from the bottom end 16.

A top member 22 is provided having a top edge 24, a bottom edge 26 and a peripheral wall 28 attached to and extending between the top edge 24 and the bottom edge 26. The top edge 24 defines an opening 30 extending into an interior 32 of the top member 22. The top member 22 may be telescopic relative to the base member 12. In particular, an outer diameter of the peripheral wall 28 of the top member 22 may be smaller than an inner diameter of the perimeter wall 18 of the base member 12 such that the top member 22 is positionable within an interior 34 of the base member 12. The top member 22 may have a size and shape such that the top member 22 is fully positionable within the interior 34 of the base member 12 for compact storage of the assembly 10. Each of the base member 12 and the top member 22 may be cylindrical. A pair of reflective bands 36, 38, which are conventional, may be provided. Each of the reflective bands 36, 38 may be coupled to and extend around an associated one of the top member 22 and the base member 12.

A lid 40 is positionable on the top edge 24 of the top member 22 to cover the opening 30 into the interior 32 of the top member 22. The lid 40 has a top section 42 and a peripheral surface 44 attached to and extending downwardly from the top section 42. The peripheral surface 44 is positionable to abut the peripheral wall 28 of the top member 22 for securing the lid 40 and the top member 22. The peripheral surface 44 may have a plurality of slots 46 extending therein wherein each of the slots 46 is aligned with respect to each other and extends around the peripheral surface 44. Each of the slots 46 defines a respective handle 48 to facilitate lifting of the lid 40. The top section 42 may have a depression 50 extending therein. The depression 50 is configured to receive a light emitter, such as a flashlight, therein in order to draw increased attention to the assembly 10. The top section 42 may also include a projecting section 52 and a recessed section 54 wherein the recessed section 54 extends around and bounds the projecting section 52. The projecting section 52 includes a peripheral edge 56 and a planar section 58 wherein the peripheral edge 56 extends downwardly from the planar section 58. An inner surface 60 of the projecting section 52 may define a well 62 extending into the lid 40. The well 62 is configured to receive trash items therein and thus functions as a conventional trash receptacle when the lid 40 is positioned in an upside-down orientation on the top member 22.

One embodiment of the present invention is shown in FIGS. 1-5. In that embodiment, a plurality of tabs 74 is coupled to the bottom edge 26 of the top member 22 and a plurality of lips 76 is coupled to and extends outwardly from an interior surface 78 of the perimeter wall 18 of the base member 12. Each of the tabs 74 is selectively engageable with an associated one of the lips 76 for securing the top member 22 to the base member 12. The tabs 74 and the lips 76 may each be tapered.

Figure 6:
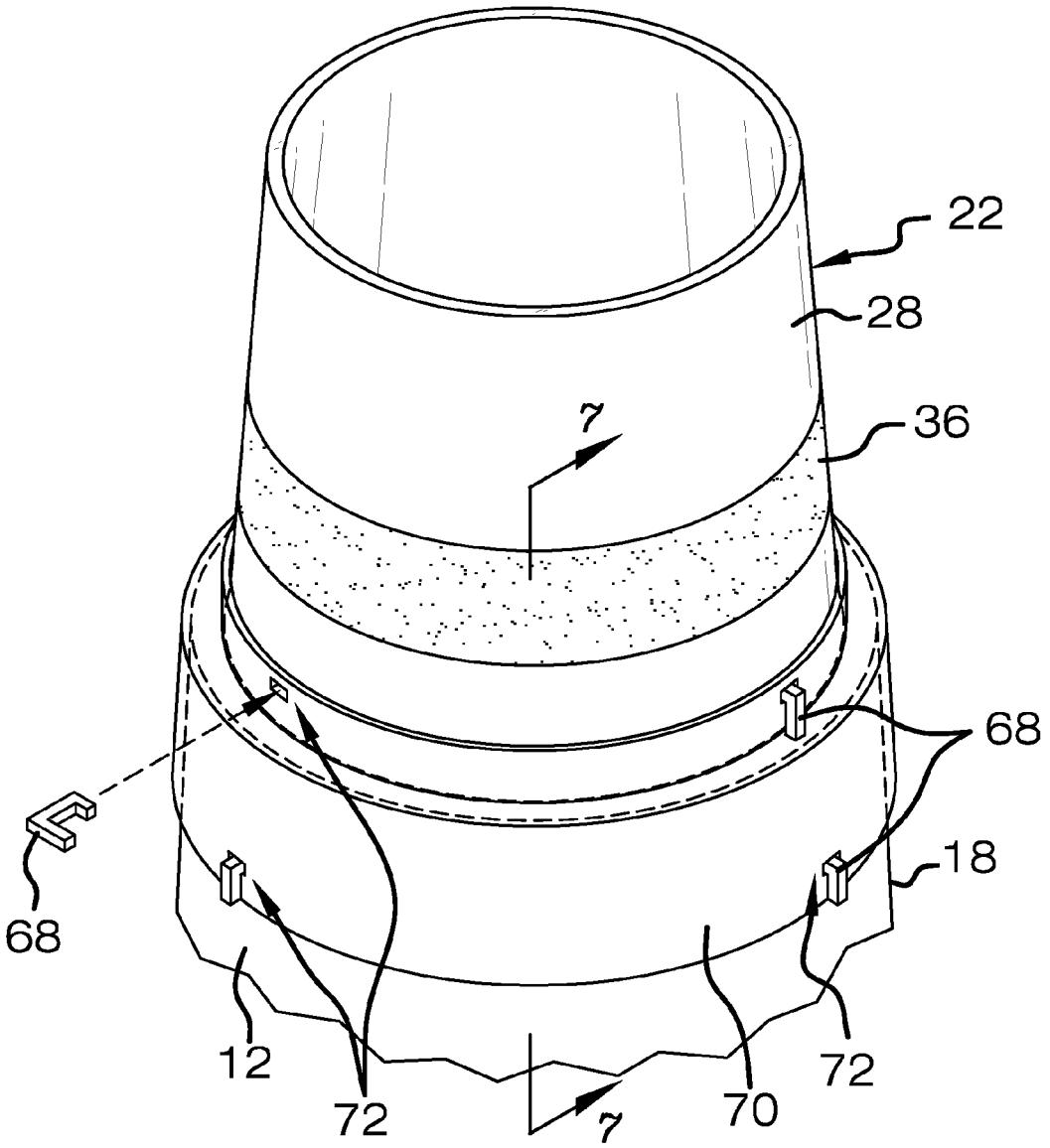
FIG. 6 is a top front side perspective view of an alternative embodiment of the disclosure.
Figure 7:
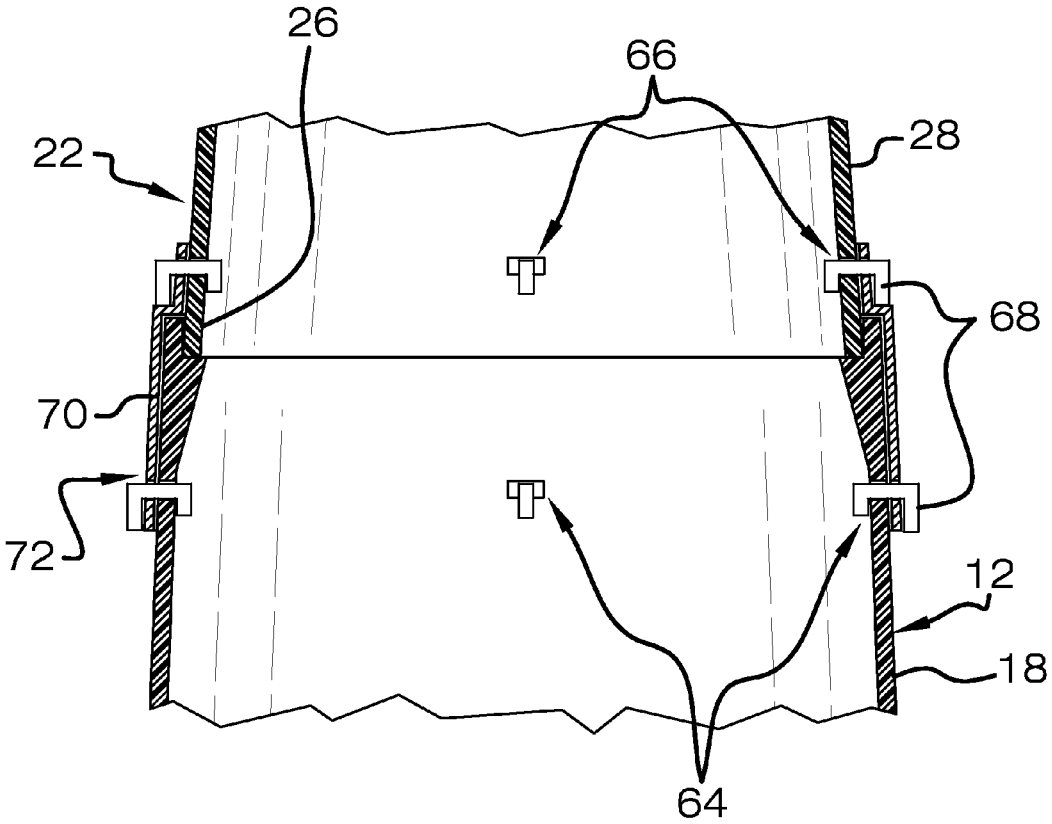
FIG. 7 is a cross-sectional view of an embodiment of the disclosure taken along line 7-7 of FIG. 6.

An alternative embodiment is shown in FIGS. 6 and 7. The alternative embodiment includes base member 12 having a plurality of apertures 64 positioned in the perimeter wall 18 that extend therearound. In addition, the top member 22 has a plurality of holes 66 positioned in the peripheral wall 28 that extend therearound proximate the bottom edge 26 of the top member 22. A plurality of fasteners 68 is provided, which may include conventional pins or the like. Each of the fasteners 68 is positionable in an associated one of the holes 66 and the apertures 64 for engaging the associated holes 66 and the apertures 64. A securing member 70 is couplable to each of the base member 12 and the top member 22 and extends around the perimeter wall 18 of the base member 12 and the peripheral wall 28 of the top member 22. The securing member 70 has a plurality of gaps 72 positioned therein. Each of the fasteners 68 is extendable through an associated one of the gaps 72 for securing the top member 22 to the base member 12. The securing member 70 may comprise a rigid band that extends a full circumference around each of the perimeter wall 18 of the base member 12 and the peripheral wall 28 of the top member 22.

An entirety of the assembly 10 may be constructed from biodegradable materials, such as peat moss or similar plant-derived material. The exterior surface of each of the top member 22 and the base member 12 may be coated with a bright orange paint to more closely resemble conventional traffic barriers and improve visibility of the assembly 10. The paint used may also be biodegradable.

In use, the assembly 10 is placed on a ground surface to alert motorists and/or pedestrians to a hazardous road condition. The base member 12 can be filled with ballast to securely hold the base member 12 in place on the ground surface. A light emitter may be placed into the depression 50 to provide enhanced visibility of the assembly 10. The reflective bands 36, 38 also help to draw attention toward the assembly 10. The top member 22 is movable within the base member 12 and permits collapsing of the assembly 10 in order to store the assembly 10 in a compact manner. The top member 22 and the base member 12 are locked in place using the tabs 74 and lips 76 or the fasteners 68 and securing member 70. The biodegradable materials of the assembly 10 provide a barrier that is more environmentally-friendly than that of conventional traffic barriers.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A traffic barrier assembly comprising:

a base member having a top end, a bottom end and a perimeter wall attached to and extending between said top end and said bottom end;

a top member having a top edge, a bottom edge and a peripheral wall attached to and extending between said top edge and said bottom edge, said top edge defining an opening extending into an interior of said top member, said top member being telescopic relative to base member;

a plurality of tabs coupled to said bottom edge of said top member; and a plurality of lips coupled to and extending outwardly from an interior surface of said perimeter wall of said base member, each of said tabs being selectively engageable with an associated one of said lips for securing said top member to said base member, each of said tabs and said lips being tapered.

2. The assembly of claim 1, further comprising a lid positionable on said top edge of said top member to cover said opening into said interior of said top member.

3. The assembly of claim 2, further comprising wherein said lid has a top section and a peripheral surface attached to and extending downwardly from said top section, said peripheral surface of said lid being positionable to abut said peripheral wall of said top member for securing said lid and said top member.

4. The assembly of claim 3, further comprising wherein said peripheral surface of said lid has a plurality of slots extending therein, each of said slots being aligned with respect to each other and extending around said peripheral surface, each of said slots defining a respective handle to facilitate lifting of said lid.

5. The assembly of claim 3, further comprising wherein said top section has a depression extending therein, said depression being configured to receive a light emitter therein.

6. The assembly of claim 3, further comprising wherein said top section includes a projecting section and a recessed section, said recessed section extending around and bounding said projecting section.

7. The assembly of claim 6, further comprising wherein said projecting section includes a peripheral edge and a planar section, said peripheral edge extending downwardly from said planar section, an inner surface of said projecting section defining a well extending into said lid, said well being configured to receive trash items therein.

8. The assembly of claim 1, further comprising an outer diameter of said peripheral wall of said top member being smaller than an inner diameter of said perimeter wall of said base member such that said top member is positionable within an interior of said base member.

9. The assembly of claim 8, further comprising wherein said top member has a size and shape such that said top member is fully positionable within said interior of said base member.

10. The assembly of claim 1, further comprising a rim attached to said bottom end of said base member and extending therearound.

11. The assembly of claim 10, further comprising said rim tapering outwardly from said bottom end of said base member.

12. The assembly of claim 1, further comprising an entirety of said assembly being constructed from biodegradable materials.

13. The assembly of claim 1, further comprising said bottom end of said base member being closed.

14. The assembly of claim 1, further comprising each of said base member and said top member being cylindrical.

15. A traffic barrier assembly comprising:

a base member having a top end, a bottom end and a perimeter wall attached to and extending between said top end and said bottom end;

a top member having a top edge, a bottom edge and a peripheral wall attached to and extending between said top edge and said bottom edge, said top edge defining an opening extending into an interior of said top member, said top member being telescopic relative to base member;

said top member having a plurality of holes positioned in said peripheral wall and extending therearound proximate said bottom edge of said top member;

said base member having a plurality of apertures positioned in said perimeter wall and extending therearound;

a plurality of fasteners, each of said fasteners being positionable in an associated one of said holes and said apertures for engaging said associated holes and said apertures; and a securing member couplable to each of said base member and said top member, said securing member being extendable around said perimeter wall of said base member and said peripheral wall of said top member, said securing member having a plurality of gaps positioned therein, each of said fasteners being extendable through an associated one of said gaps for securing said top member to said base member.

16. A traffic barrier assembly comprising:

a base member having a top end, a bottom end and a perimeter wall attached to and extending between said top end and said bottom end, said bottom end of said base member being closed;

a top member having a top edge, a bottom edge and a peripheral wall attached to and extending between said top edge and said bottom edge, said top edge defining an opening extending into an interior of said top member, said top member being telescopic relative to base member, an outer diameter of said peripheral wall of said top member being smaller than an inner diameter of said perimeter wall of said base member such that said top member is positionable within an interior of said base member, said top member having a size and shape such that said top member is fully positionable within said interior of said base member, each of said base member and said top member being cylindrical;

a lid positionable on said top edge of said top member to cover said opening into said interior of said top member, said lid having a top section and a peripheral surface attached to and extending downwardly from said top section, said peripheral surface of said lid being positionable to abut said peripheral wall of said top member for securing said lid and said top member, said peripheral surface of said lid having a plurality of slots extending therein, each of said slots being aligned with respect to each other and extending around said peripheral surface, each of said slots defining a respective handle to facilitate lifting of said lid, said top section having a depression extending therein, said depression being configured to receive a light emitter therein, said top section including a projecting section and a recessed section, said recessed section extending around and bounding said projecting section, said projecting section including a peripheral edge and a planar section, said peripheral edge extending downwardly from said planar section, an inner surface of said projecting section defining a well extending into said lid, said well being configured to receive trash items therein;

a rim attached to said bottom end of said base member and extending therearound, said rim tapering outwardly from said bottom end of said base member;

a pair of reflective bands, each of said reflective bands being coupled to and extending around an associated one of said top member and said base member; and wherein an entirety of said assembly is constructed from biodegradable materials;

said base member having a plurality of apertures positioned in said perimeter wall and extending therearound;

said top member having a plurality of holes positioned in said peripheral wall and extending therearound proximate said bottom edge of said top member;

a plurality of fasteners, each of said fasteners being positionable in an associated one of said holes and said apertures for engaging said associated holes and said apertures; and a securing member couplable to each of said base member and said top member, said securing member being extendable around said perimeter wall of said base member and said peripheral wall of said top member, said securing member having a plurality of gaps positioned therein, each of said fasteners being extendable through an associated one of said gaps for securing said top member to said base member.

* * * * *